United States Patent [19]

Hamada

[11] 4,358,141

[45] Nov. 9, 1982

[54] NOISE PREVENTION DEVICE IN AN AUTOMOBILE LOCKING APPARATUS

[75] Inventor: Yoshikazu Hamada, Tokyo, Japan

[73] Assignee: Mitsui Kinzoku Kogyo Kabushiki Kaisha, Tokyo, Japan

[21] Appl. No.: 135,900

[22] Filed: Mar. 31, 1980

[30] Foreign Application Priority Data

Apr. 7, 1979 [JP] Japan ..... 54-42179
Apr. 7, 1979 [JP] Japan ..... 54-46029[U]
Apr. 7, 1979 [JP] Japan ..... 54-46031[U]

[51] Int. Cl.[3] ..... E05C 3/26

[52] U.S. Cl. ..... 292/216; 292/DIG. 38; 292/DIG. 56

[58] Field of Search ..... 292/216, 341.12, DIG. 38, 292/DIG. 56, 356

[56] References Cited

U.S. PATENT DOCUMENTS 1,194,636 8/1916 Joy ..... 292/DIG. 56 X
4,073,519 2/1978 Kuroyu et al. ..... 292/DIG. 56 X
4,165,112 8/1979 Kleefeldt ..... 292/216
4,235,462 11/1980 Torii et al. ..... 292/216

*Primary Examiner*—Richard E. Moore
*Attorney, Agent, or Firm*—Browdy and Neimark

[57] ABSTRACT

Noise prevention devices in an automobile door locking apparatus, which include a resilient cover mounted to a latch, a spiral torsion spring mounted to a shaft of said latch, and other resilient means. Said cover lessens striking noise between said latch and an automobile door striker and also between said latch and a ratchet for locking the former, and also acts to lessen rubbing noise between said latch and a cover plate of the apparatus housing. Said torsion spring cushions also, in addition to biasing the latch, to prevent the rattling of said latch.

10 Claims, 16 Drawing Figures

NOISE PREVENTION DEVICE IN AN AUTOMOBILE LOCKING APPARATUS

Figure 1:
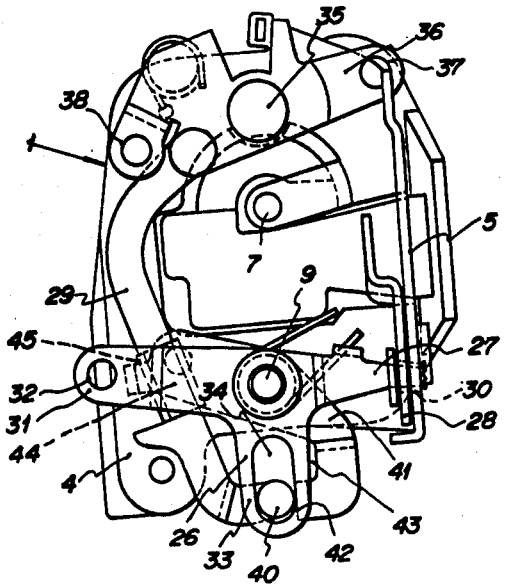

This invention relates to noise prevention devices in an automobile door locking apparatus.

While the automobile door locking apparatus comprises various component parts assembled within and fitted to a housing which is in turn fixed to the door, which include a latch engageable with a striker fitted to an automobile body part, a ratchet for the prevention of reverse of the latch, an open lever for releasing the engagement of ratchet with the latch, a locking lever for releasing the engagement of said open lever with the ratchet, and others, said component parts vibrate and produce noise when the door is closed or opened and when the automobile is running.

To wit, when the door is closed, the striker strikes against a recess formed on the circumferential surface of the latch, producing bumping noise, and a pawl of the ratchet abuts momentarily to one of shoulders and its bottom which are formed on the above-mentioned surface of latch for effecting its half or preliminary locking by the ratchet, producing clicking noise. When the vehicle runs, the latch sometimes rattles, and the open lever, locking lever and others rub each other, as they are placed one above another in a narrow housing space.

Various devices have been developed for eliminating or minimizing such noise as mentioned above. For example, an elastic cushion is insertedly fitted to the recess of latch at a location where the striker strikes against it. The circumferential surface of latch is insertedly fitted by a cushion, at its position where the pawl of ratchet strikes. These structures can prevent noise. However, they have certain drawbacks, especially with respect to their complexity and difficulty of mounting.

In the present invention, such conventional cushions which are individually or independently fitted to the latch, are made integral so that they can be fitted readily with a single step, while a portion connecting the cushions is made plane so that it can lie between the latch and a cover plate of the apparatus housing, for preventing the rattling of the latch and the noise accompanied thereto. In the present invention, a spiral torsion spring which biases the latch to a selected direction about its axis, is employed as a resilient force exerting upon the latch transversely to its plane, for preventing its rattling and noise. There are disclosed also, in this invention, other novel resilient means which can prevent the component parts from making a rubbing or striking noise at locations where they lie one over another, or where they cross each other.

Figure 3:
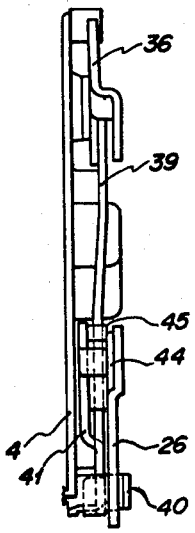
Figure 4:
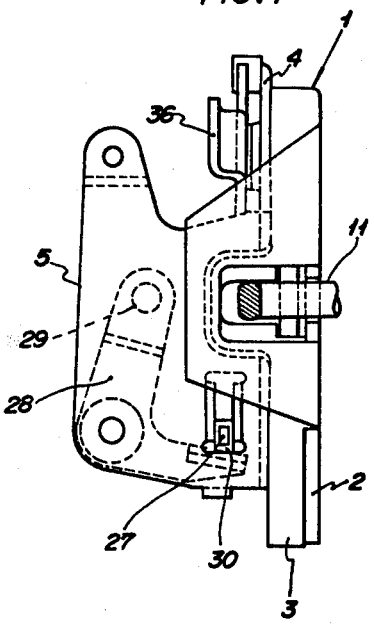
Figure 2:
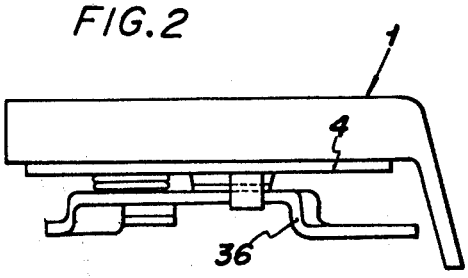
Figure 5:
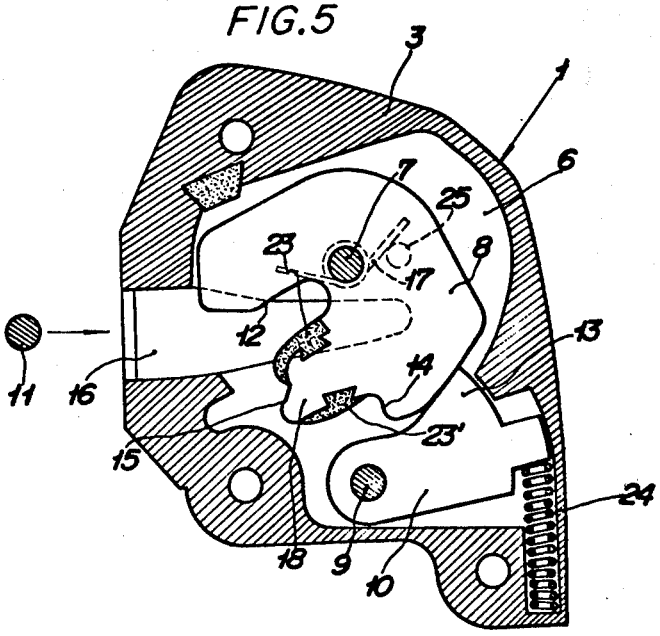
Figure 6:
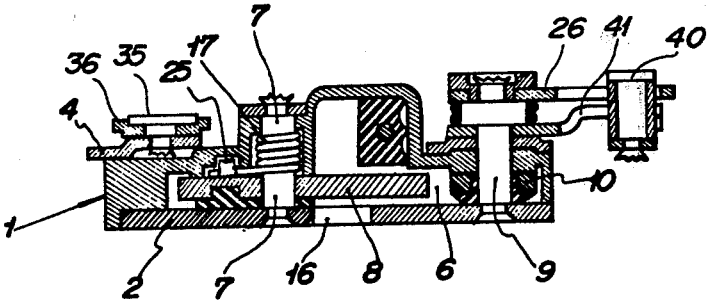
Figure 7:
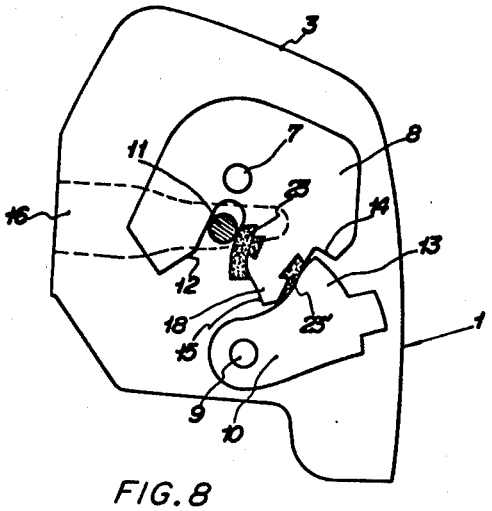
Figure 8:
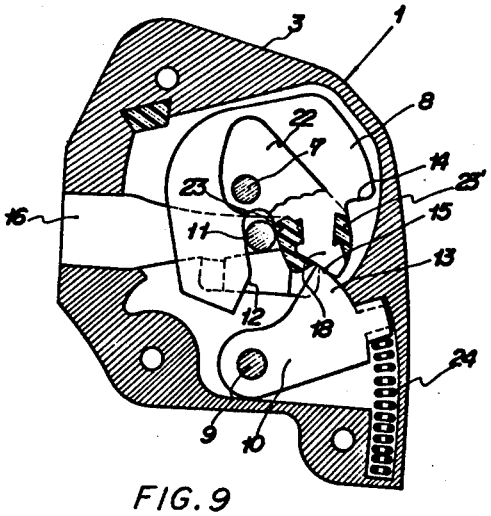
Figure 9:
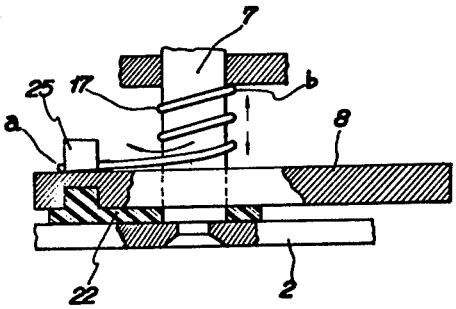
Figure 10:
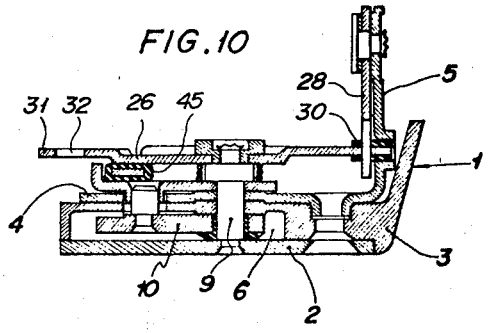
Figure 11:
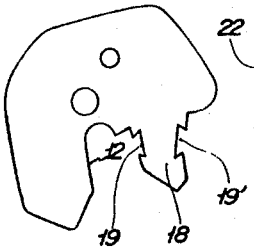
Figure 12:
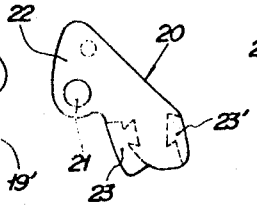
Figure 13:
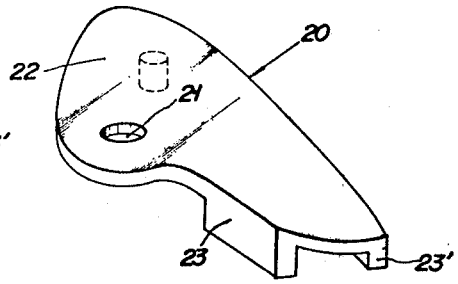
Figures 14, 15, 16:
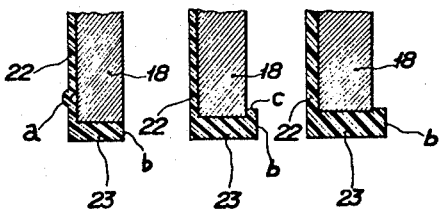

In the drawing which shows preferred embodiments of this invention;

FIG. 1 is a front view of an automobile door locking apparatus incorporated with noise prevention devices made in accordance with this invention, FIG. 2 is a plan view thereof, FIG. 3 is a left-side view thereof, FIG. 4 is a right-side view thereof, FIG. 5 is a back view thereof, with a cover plate being removed, FIG. 6 is a vertical cross sectional view, FIG. 7 is an explanatory view showing locking devices at the half-locking position, FIG. 8 is a view similar to FIG. 7, but at the full locking position, FIG. 9 is a partial cross sectional view, showing the latch and parts associated therewith, FIG. 10 is a horizontal cross sectional view of the apparatus, FIG. 11 is a front view of a latch made in accordance with this invention, FIG. 12 is a front view of a resilient cushion body made in accordance with this invention, FIG. 13 is a perspective view of said cushion body, and FIGS. 14 to 16 are sectional views of embodiments of said cushion body.

Now, with reference to the drawing, numeral 1 indicates generally a locking mechanism fitted to an automobile door, 2 a cover plate for said mechanism, and 3 a body for housing said mechanism. The body 3 is usually made from synthetic resins and the like, and a metallic back plate 4 is mounted over the upper surface of said body 3. As best shown in FIG. 10, a side of said plate 4 projects at a right angle to its base portion and forms an erected part 5. The body 3 has a concave housing 6 in which a latch 8 engageable with a striker 11 of the vehicle body is pivotally fixed by a shaft 7. Also, in the concave housing, a ratchet 10 is pivotally fixed by a shaft 9. The latch is provided at its circumferential surface with a recess 12 which meshs and engages with the striker 11 and shoulders 14, 15 which are engageable with a pawl 13 of the ratchet 10 to prevent reversal of the latch 8. The said shoulder 14 is for temporarily or momentarily preventing the rotation of the latch by its engagement with the pawl, and the shoulder 15 is for completely locking the rotation of the latch 8. The latch 8 and the ratchet 10 are respectively pivotally fixed so as to rotate in a common plane. Numeral 16 indicates a slot opening formed to the body 3 and cover plate 2 for receiving therein the striker 11. The recess 12 of the latch 8 faces, as shown in FIG. 5, to the slot opening 16, when the automobile door is open, so as to be ready to receive the striker thereto.

As shown in FIGS. 5 and 9, the latch 8 is provided with a spring 17 so as to be biased clockwise in FIG. 5. This spring 17 is more particularly a spiral torsion spring mounted about the shaft 7 of latch 8, which spring has functions to afford torsion and also to afford resiliency axially of said shaft 7. Hence, it biases the latch 8 clockwise in FIG. 5, and also gives resilient pressure working on the latch 8 downwardly in FIG. 9, resulting in preventing rattling of said latch.

On a projection 18, which provides the latch 8 with the primary shoulder 15, there are provided at its sides cut-out portions 19, 19' into which are insertedly fitted parts 23, 23' of resilient cushion body 20 to finally shape up the recess 12 and shoulder 15 of the latch, when the latter is fixedly mounted of its part by said resilient cushion body 20 (FIGS. 12 and 13). As best shown in FIG. 13, said resilient cushion body 20 comprises a flat portion 22 which lies on a side part of the latch 8. Said flat portion has a bore 21 through which the shaft 7 extends. As described above, the part 23 of cushion body 20 which is insertedly fitted to the cut-out portion 19, shapes up the recess 12 and shoulder 15, and the another part 23' which is insertedly fitted to the cut-out portion 19' constitutes a bottom part of the secondary shoulder 14. The vertical cross section of the said cushion body is generally of the shape of a reversed letter U. In FIG. 5, numeral 24 indicates a coil spring which biases the ratchet counter-clockwise so as to make it contact resiliently with the circumferential surface of latch 8 including its shoulders 14, 15. Numeral 25 indicates a detent pin with which one end of the spiral torsion spring 17 engages.

FIGS. 14 to 16 show embodiments of the resilient cushion body 20, more particularly flat portion 22 and parts 23, 23' thereof. In FIG. 14, the flat portion 22 is provided with a rib a which resiliently abuts against the housing body 3. In FIG. 15 the part 23 is thicker than the projection 18 of latch 8 to have a projection b and embraces said projection at c for minimizing rubbing noise between the latch and the cover plate 2. In FIG. 16 only the projection b is formed for the same purpose with FIG. 15.

In FIGS. 1 to 4 in which the whole outer appearance of the apparatus thus assembled is shown, to the shaft 9 there is pivotally fixed a T-shaped open lever 26 coaxially with the ratchet 10. An arm 27 of the said open lever abuts against a rotary lever 28, while said rotary lever is connected to an interior door handle through suitable connecting means. The end of arm 27 is covered by resilient materials 30. To a hole 32 which is provided at another arm 31 of the open lever 26, there is connected an exterior door handle. An elongated slot opening 34 which extends radially to the shaft 9, is provided in a central arm 33 of locking lever 26. In the drawing, particularly FIG. 1 thereof, a locking lever 36 is pivotally fixed at its center by a shaft 35 at an upper location of the apparatus. To one end 37 of said lever 36 there is indirectly connected a key, and to another end 38 there is connected indirectly a locking knob. An upper end of connecting lever 39 is pivotally connected to the lever 36, a pin 40 fixed to the lower end of said connecting lever being engaged to the elongaged slot opening 34. An actuator lever 41 is fitted to the shaft 9, a part of which lever is formed to an abutment 42 which faces a lower half part of the elongated slot 34. Said actuator lever 41 has an idle part 43 which locates between the abutment 42 and the shaft 9 and which is not provided with any abutment. The arm 31 of open lever 26 and the connecting lever 39 lie one above another, and form a crossing 44. The connecting lever 39 is covered by resilient materials 45 at its part corresponding to said crossing, in order to eliminate rubbing noise between the two levers.

In this invention having the above constructions, when an automobile door is closed, the striker 11, in FIG. 5, comes to make engagement with the recess 12 of latch 8, passing through the slot opening 16, and this strike and engagement of the striker with the recess 12 rotates the latch counter-clockwise to effect its locking as shown in FIG. 8 (via FIG. 7), wherein the pawl 13 of ratchet 10 engages with the shoulder 15 for completely preventing the reverse of latch 8. In connection with the above operation, it shall be noted that though the striker 11 strikes against the recess 12, there is not produced any noticeable noise, because the resilient part 23 cushions. Likewise, the resilient part 23' cushions the striking of pawl 13 of ratchet 10 against the secondary shoulder when the pawl momentarily locks the latch, whereby no noticeable noise is produced.

The flat portion 22 which connects said resilient parts 23 and 23' as an integral cushion body, enables them to be fitted to their locations readily by a single step, and in addition, it works by itself to prevent the rattling of latch 8 as it lies between the cover plate 2 and said latch 8. As illustrated in FIG. 9 and as described above, the spiral torsion spring 17 constantly biases the latch 8 to the position as shown in FIG. 5, and it can also unge the latch 8 resiliently towards the cover plate 2 on account of the resiliency working along its axial direction also. This means that single spring achieves effectively two performances. Also, as described in the above and as illustrated in the drawing, especially in FIG. 10, those component parts which abut to each other, lie over or under another, or cross, are mounted with cushions such as the resilient materials 30, 45.

What is claimed is:

1. In an automobile door locking apparatus comprising a latch, said latch comprising a projection which at one side surface together with other parts of said latch defines a recess engageable with a striker mounted on an automobile body, a ratchet engageable with a shoulder formed on another side surface of said projection to prevent reverse motion of said latch, an open lever operative to release the engagement between said ratchet and said latch, and noise prevention means comprising an integral resilient body having portions overlying said latch projection one side surface and another side surface and the portion of another surface of said latch projection between said one and said another side surfaces of said latch projection.

2. In an automobile door locking apparatus comprising a latch having a recess engageable with a striker on the automobile body, a ratchet engageable with a shoulder of said latch to prevent reverse motion of said latch, an open lever operative to release the engagement of the ratchet with the latch, and noise prevention means which comprises a spiral spring mounted on a shaft for the latch which biases said latch in a selected direction about said shaft and which also provides resilient force upon the latch axially of said shaft.

3. Noise prevention device as claimed in claim 1, in which said resilient means is consisted of a resilient body which has an integral part projection onto an inner circumferential wall part of the recess where the striker strikes and another integral part projecting onto the bottom of a shoulder other than the aforementioned shoulder where the ratchet temporarily engages.

4. Noise prevention device as claimed in claim 3, in which the resilient body has a hole through which a shaft for the latch is fitted.

5. Noise prevention device as claimed in claim 3, in which the latch projection is provided adjacent to the shoulders with cut-out portions to which the resilient parts are respectively insertedly fitted.

6. Noise prevention device as claimed in claim 3, in which the resilient body has a projection projecting over the latch at its surface opposite to its another surface over which the resilient body lies, said projection cushioning between said latch and a housing for the latch.

7. Noise prevention device as claimed in claim 2, in which resilient means cushions between the latch and a cover plate fitted over a housing body of the apparatus.

8. Noise prevention device as claimed in claim 7, in which said resilient means comprises a resilient body which has an integral part projecting onto an inner circumferential wall part of the recess where the striker strikes and another integral part projecting onto the bottom of a shoulder other than the aforementioned shoulder where the ratchet temporarily engages, and which is mounted over a part of the latch.

9. Noise prevention devices as claimed in claim 1, in which there is provided resilient means which are fitted to one or more of other component parts at a location where they abut or cross each other.

10. Noise prevention device as claimed in claim 2, in which there is provided another resilient means which are fitted to one or more of the component parts at a location where they abut or cross each other.

* * * * *